US011311849B2

(12) United States Patent
Warren et al.

(10) Patent No.: US 11,311,849 B2
(45) Date of Patent: Apr. 26, 2022

(54) LOADING AND UNLOADING OF BULK MATERIAL CONTAINERS FOR ON SITE BLENDING

(71) Applicant: Halliburton Energy Services, Inc., Houston, TX (US)

(72) Inventors: Wesley John Warren, Marlow, OK (US); Calvin L. Stegemoeller, Duncan, OK (US); Chad Adam Fisher, Cache, OK (US); Bryan Chapman Lucas, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 378 days.

(21) Appl. No.: 16/067,474

(22) PCT Filed: Mar. 31, 2016

(86) PCT No.: PCT/US2016/025286
§ 371 (c)(1),
(2) Date: Jun. 29, 2018

(87) PCT Pub. No.: WO2017/171797
PCT Pub. Date: Oct. 5, 2017

(65) Prior Publication Data

US 2019/0009231 A1 Jan. 10, 2019

(51) Int. Cl.
*B01F 35/71* (2022.01)
*B01F 33/501* (2022.01)
(Continued)

(52) U.S. Cl.
CPC ..... *B01F 33/5013* (2022.01); *B01F 23/50* (2022.01); *B01F 35/71731* (2022.01); *E21B 21/062* (2013.01)

(58) Field of Classification Search
CPC ..... B01F 15/0235; B01F 35/71731
(Continued)

(56) References Cited

U.S. PATENT DOCUMENTS 710,611 A 10/1902 Ray
802,254 A * 10/1905 Baker ..... A23L 3/02 99/364
(Continued)

FOREIGN PATENT DOCUMENTS

EP 2937826 A1 10/2015
GB 2066220 A 7/1981
(Continued)

OTHER PUBLICATIONS

International Search Report and Written Opinion issued in related PCT Application No. PCT/US2016/025286 dated Dec. 28, 2016, 10 pages.

*Primary Examiner* — David L Sorkin
(74) *Attorney, Agent, or Firm* — Conley Rose, P.C.; Rodney B. Carroll

(57) ABSTRACT

An example system includes a blender unit for producing a treatment fluid, the blender unit being configured to hold at least one portable bulk material container thereon. The system further includes a first device responsible for loading portable bulk material containers onto the blender unit, and a second device responsible for unloading portable bulk material containers from the blender unit.

20 Claims, 4 Drawing Sheets

(51) Int. Cl.
*E21B 21/06* (2006.01)
*B01F 23/50* (2022.01)

(58) Field of Classification Search
USPC ..... 366/183.1
See application file for complete search history.

(56) References Cited

U.S. PATENT DOCUMENTS 917,646 A 4/1909 Otto
1,519,153 A * 12/1924 Mitton ..... B01F 9/0016 366/109
1,726,603 A 9/1929 Allen
1,795,987 A 3/1931 Adams
2,231,911 A 2/1941 Hitt et al.
2,281,497 A * 4/1942 Hyson ..... F23K 3/06 366/153.2
2,385,245 A 9/1945 Willoughby
2,415,782 A * 2/1947 Zademach ..... 366/218
2,513,012 A 6/1950 Dugas
2,563,470 A 8/1951 Kane
2,652,174 A 9/1953 Shea
2,670,866 A 3/1954 Glesby
2,678,737 A 5/1954 Mangrum
2,703,659 A 3/1955 Hutchins, V
2,756,073 A 7/1956 Bridge
2,759,737 A 8/1956 Manning
2,802,603 A 8/1957 McCray
2,867,336 A 1/1959 Soldini et al.
3,049,248 A 8/1962 Heltzel et al.
3,083,879 A 4/1963 Coleman
3,151,779 A 10/1964 Rensch et al.
3,203,370 A 8/1965 Friedrich et al.
3,217,927 A 11/1965 Bale, Jr. et al.
3,318,473 A 5/1967 Jones et al.
3,326,572 A 6/1967 Murray
3,343,688 A 9/1967 Ross
3,354,918 A 11/1967 Coleman
3,380,333 A 4/1968 Clay et al.
3,404,963 A 10/1968 Fritsche et al.
3,410,530 A 11/1968 Gilman
3,432,151 A 3/1969 O'Loughlin et al.
3,467,408 A 9/1969 Regalia
3,476,270 A 11/1969 Cox et al.
3,602,400 A 8/1971 Cooke
3,627,555 A 12/1971 Driscoll
3,698,693 A 10/1972 Poncet
3,785,534 A 1/1974 Smith
3,802,584 A 4/1974 Sackett, Sr. et al.
3,986,708 A 10/1976 Heltzel et al.
4,023,719 A 5/1977 Noyon
4,058,239 A 11/1977 Van Mill
4,138,163 A 2/1979 Calvert et al.
4,178,117 A 12/1979 Brugler
4,204,773 A 5/1980 Bates
4,248,337 A 2/1981 Zimmer
4,258,953 A 3/1981 Johnson
4,313,708 A 2/1982 Tiliakos
4,395,052 A 7/1983 Rash
4,398,653 A 8/1983 Daloisio
4,423,884 A 1/1984 Gevers
4,544,279 A 10/1985 Rudolph
4,548,507 A 10/1985 Mathis et al.
4,583,663 A 4/1986 Bonerb
4,626,166 A 12/1986 Jolly
4,701,095 A 10/1987 Berryman et al.
4,806,065 A 2/1989 Holt et al.
4,850,702 A 7/1989 Arribau et al.
4,856,681 A 8/1989 Murray
4,900,157 A 2/1990 Stegemoeller et al.
4,956,821 A 9/1990 Fenelon
4,993,883 A 2/1991 Jones
4,997,335 A 3/1991 Prince
5,036,979 A 8/1991 Selz
5,096,096 A 3/1992 Calaunan
5,114,169 A 5/1992 Botkin et al.
5,149,192 A 9/1992 Hamm et al.
5,303,998 A 4/1994 Whitlatch et al.
5,339,996 A 8/1994 Dubbert et al.
5,343,813 A 9/1994 Septer
5,375,730 A 12/1994 Bahr et al.
5,401,129 A 3/1995 Eatinger
5,413,154 A 5/1995 Hurst, Jr. et al.
5,426,137 A 6/1995 Allen
5,441,321 A 8/1995 Karpisek
5,443,350 A 8/1995 Wilson
5,445,289 A 8/1995 Owen
5,590,976 A 1/1997 Kilheffer et al.
5,609,417 A 3/1997 Otte
5,722,552 A 3/1998 Olson
5,772,390 A 6/1998 Walker
5,806,441 A 9/1998 Chung
5,913,459 A 6/1999 Gill et al.
5,915,913 A 6/1999 Greenlaw et al.
5,927,356 A 7/1999 Henderson
5,944,470 A 8/1999 Bonerb
5,997,099 A 12/1999 Collins
6,059,372 A 5/2000 McDonald et al.
6,112,946 A 9/2000 Bennett et al.
6,126,307 A 10/2000 Black et al.
6,193,402 B1 2/2001 Grimland et al.
6,247,594 B1 6/2001 Garton
6,379,086 B1 4/2002 Goth
6,425,627 B1 7/2002 Gee
6,491,421 B2 12/2002 Rondeau et al.
6,517,232 B1 2/2003 Blue
6,536,939 B1 3/2003 Blue
6,537,015 B2 3/2003 Lim et al.
6,568,567 B2 5/2003 McKenzie et al.
6,622,849 B1 9/2003 Sperling
6,655,548 B2 12/2003 McClure et al.
6,876,904 B2 4/2005 Oberg et al.
6,980,914 B2 12/2005 Bivens et al.
7,008,163 B2 3/2006 Russell
7,086,342 B2 8/2006 O'Neall et al.
7,100,896 B1 9/2006 Cox
7,114,905 B2 10/2006 Dibdin
7,252,309 B2 8/2007 Eng Soon et al.
7,284,579 B2 10/2007 Elgan
7,451,015 B2 11/2008 Mazur et al.
7,475,796 B2 1/2009 Garton
7,500,817 B2 3/2009 Furrer et al.
7,513,280 B2 4/2009 Brashears et al.
7,665,788 B2 2/2010 Dibdin et al.
7,762,281 B2 7/2010 Schuld
7,997,213 B1 8/2011 Gauthier et al.
8,387,824 B2 3/2013 Wietgrefe
8,434,990 B2 5/2013 Claussen
D688,349 S 8/2013 Oren et al.
D688,350 S 8/2013 Oren et al.
D688,351 S 8/2013 Oren et al.
D688,772 S 8/2013 Oren et al.
8,505,780 B2 8/2013 Oren
8,545,148 B2 10/2013 Wanek-Pusset et al.
8,573,917 B2 11/2013 Renyer
8,585,341 B1 11/2013 Oren et al.
8,607,289 B2 12/2013 Brown et al.
8,616,370 B2 12/2013 Allegretti et al.
8,622,251 B2 1/2014 Oren
8,662,525 B1 3/2014 Dierks et al.
8,668,430 B2 3/2014 Oren et al.
D703,582 S 4/2014 Oren
8,827,118 B2 9/2014 Oren
8,834,012 B2 9/2014 Case et al.
8,887,914 B2 11/2014 Allegretti et al.
RE45,713 E 10/2015 Oren et al.
9,162,603 B2 10/2015 Oren
RE45,788 E 11/2015 Oren et al.
9,248,772 B2 2/2016 Oren
RE45,914 E 3/2016 Oren et al.
9,296,518 B2 3/2016 Oren
9,340,353 B2 5/2016 Oren et al.
9,358,916 B2 6/2016 Oren
9,394,102 B2 7/2016 Oren et al.
9,403,626 B2 8/2016 Oren

(56) References Cited

U.S. PATENT DOCUMENTS

| | | | |
|---|---|---|---|
| 9,421,899 | B2 | 8/2016 | Oren |
| 9,440,785 | B2 | 9/2016 | Oren et al. |
| 9,446,801 | B1 | 9/2016 | Oren |
| 9,475,661 | B2 | 10/2016 | Oren |
| 9,511,929 | B2 | 12/2016 | Oren |
| 9,522,816 | B2 | 12/2016 | Taylor |
| 9,527,664 | B2 | 12/2016 | Oren |
| 9,580,238 | B2 | 2/2017 | Friesen et al. |
| RE46,334 | E | 3/2017 | Oren et al. |
| 9,617,065 | B2 | 4/2017 | Allegretti et al. |
| 9,617,066 | B2 | 4/2017 | Oren |
| 9,624,030 | B2 | 4/2017 | Oren et al. |
| 9,624,036 | B2 | 4/2017 | Luharuka et al. |
| 9,643,774 | B2 | 5/2017 | Oren |
| 9,650,216 | B2 | 5/2017 | Allegretti |
| 9,656,799 | B2 | 5/2017 | Oren et al. |
| 9,669,993 | B2 | 6/2017 | Oren et al. |
| 9,670,752 | B2 | 6/2017 | Glynn et al. |
| 9,676,554 | B2 | 6/2017 | Glynn et al. |
| 9,682,815 | B2 | 6/2017 | Oren |
| 9,694,970 | B2 | 7/2017 | Oren et al. |
| 9,701,463 | B2 | 7/2017 | Oren et al. |
| 9,718,609 | B2 | 8/2017 | Oren et al. |
| 9,718,610 | B2 | 8/2017 | Oren |
| 9,725,233 | B2 | 8/2017 | Oren et al. |
| 9,725,234 | B2 | 8/2017 | Oren et al. |
| 9,738,439 | B2 | 8/2017 | Oren et al. |
| RE46,531 | E | 9/2017 | Oren et al. |
| 9,758,081 | B2 | 9/2017 | Oren |
| 9,758,993 | B1 | 9/2017 | Allegretti et al. |
| 9,771,224 | B2 | 9/2017 | Oren et al. |
| 9,783,338 | B1 | 10/2017 | Allegretti et al. |
| 9,796,319 | B1 | 10/2017 | Oren |
| 9,796,504 | B1 | 10/2017 | Allegretti et al. |
| 9,809,381 | B2 | 11/2017 | Oren et al. |
| 9,828,135 | B2 | 11/2017 | Allegretti et al. |
| 9,840,366 | B2 | 12/2017 | Oren et al. |
| 9,969,564 | B2 | 5/2018 | Oren et al. |
| 9,988,182 | B2 | 6/2018 | Allegretti et al. |
| 10,059,246 | B1 | 8/2018 | Oren |
| 10,081,993 | B2 | 9/2018 | Walker et al. |
| 10,189,599 | B2 | 1/2019 | Allegretti et al. |
| 10,207,753 | B2 | 2/2019 | O'Marra et al. |
| 10,287,091 | B2 | 5/2019 | Allegretti |
| 10,308,421 | B2 | 6/2019 | Allegretti |
| 10,486,854 | B2 | 11/2019 | Allegretti et al. |
| 10,518,828 | B2 | 12/2019 | Oren et al. |
| 10,569,242 | B2 | 2/2020 | Stegemoeller et al. |
| 10,604,338 | B2 | 3/2020 | Allegretti |
| 2002/0121464 | A1 | 9/2002 | Soldwish-Zoole et al. |
| 2003/0159310 | A1 | 8/2003 | Hensley et al. |
| 2004/0008571 | A1 | 1/2004 | Coody et al. |
| 2004/0031335 | A1 | 2/2004 | Fromme et al. |
| 2004/0206646 | A1 | 10/2004 | Goh et al. |
| 2004/0258508 | A1 | 12/2004 | Jewell |
| 2005/0219941 | A1 | 10/2005 | Christenson et al. |
| 2006/0013061 | A1 | 1/2006 | Bivens et al. |
| 2007/0014185 | A1 | 1/2007 | Diosse et al. |
| 2007/0201305 | A1 | 8/2007 | Heilman et al. |
| 2008/0187423 | A1 | 8/2008 | Mauchle |
| 2008/0294484 | A1 | 11/2008 | Furman et al. |
| 2009/0078410 | A1 | 3/2009 | Krenek et al. |
| 2009/0129903 | A1 | 5/2009 | Lyons, III |
| 2009/0292572 | A1 | 11/2009 | Alden et al. |
| 2009/0314791 | A1 | 12/2009 | Hartley et al. |
| 2010/0196129 | A1 | 8/2010 | Buckner |
| 2010/0319921 | A1 | 12/2010 | Eia et al. |
| 2011/0203699 | A1 | 8/2011 | Rodgers |
| 2012/0017812 | A1 | 1/2012 | Renyer et al. |
| 2012/0018093 | A1 | 1/2012 | Zuniga et al. |
| 2012/0037231 | A1 | 2/2012 | Janson |
| 2012/0181093 | A1 | 7/2012 | Fehr et al. |
| 2012/0219391 | A1 | 8/2012 | Teichrob et al. |
| 2013/0128687 | A1 | 5/2013 | Adams |
| 2013/0135958 | A1 | 5/2013 | O'Callaghan |
| 2013/0142601 | A1 | 6/2013 | McIver et al. |
| 2013/0206415 | A1 | 8/2013 | Sheesley |
| 2013/0284729 | A1 | 10/2013 | Cook et al. |
| 2014/0023463 | A1 | 1/2014 | Oren |
| 2014/0023464 | A1 | 1/2014 | Oren et al. |
| 2014/0030031 | A1 | 1/2014 | Stevenson et al. |
| 2014/0044508 | A1 | 2/2014 | Luharuka et al. |
| 2014/0076569 | A1 | 3/2014 | Pham et al. |
| 2014/0083554 | A1 | 3/2014 | Harris |
| 2014/0216302 | A1 | 8/2014 | Ober |
| 2014/0216736 | A1 | 8/2014 | Leugemors et al. |
| 2014/0299226 | A1 | 10/2014 | Oren et al. |
| 2014/0305769 | A1 | 10/2014 | Eiden, III et al. |
| 2014/0377042 | A1 | 12/2014 | McMahon |
| 2015/0003943 | A1 | 1/2015 | Oren et al. |
| 2015/0003955 | A1 | 1/2015 | Oren et al. |
| 2015/0016209 | A1 | 1/2015 | Barton et al. |
| 2015/0162221 | A1 | 6/2015 | Lee et al. |
| 2015/0183578 | A9 | 7/2015 | Oren et al. |
| 2015/0191318 | A1 | 7/2015 | Martel |
| 2015/0284194 | A1 | 10/2015 | Oren et al. |
| 2015/0353293 | A1 | 12/2015 | Richard |
| 2015/0360856 | A1 | 12/2015 | Oren et al. |
| 2015/0366405 | A1 | 12/2015 | Manchuliantsau |
| 2015/0368052 | A1 | 12/2015 | Sheesley |
| 2015/0375930 | A1 | 12/2015 | Oren et al. |
| 2016/0031658 | A1 | 2/2016 | Oren et al. |
| 2016/0039433 | A1 | 2/2016 | Oren et al. |
| 2016/0046438 | A1 | 2/2016 | Oren et al. |
| 2016/0046454 | A1 | 2/2016 | Oren et al. |
| 2016/0068342 | A1 | 3/2016 | Oren et al. |
| 2016/0130095 | A1 | 5/2016 | Oren et al. |
| 2016/0244279 | A1 | 8/2016 | Oren et al. |
| 2016/0264352 | A1 | 9/2016 | Oren |
| 2016/0332809 | A1 | 11/2016 | Harris |
| 2016/0332811 | A1 | 11/2016 | Harris |
| 2017/0021318 | A1 | 1/2017 | McIver et al. |
| 2017/0123437 | A1 | 5/2017 | Boyd et al. |
| 2017/0129696 | A1 | 5/2017 | Oren |
| 2017/0144834 | A1 | 5/2017 | Oren et al. |
| 2017/0190523 | A1 | 7/2017 | Oren et al. |
| 2017/0203915 | A1 | 7/2017 | Oren |
| 2017/0217353 | A1 | 8/2017 | Vander Pol et al. |
| 2017/0217671 | A1 | 8/2017 | Allegretti |
| 2017/0225883 | A1 | 8/2017 | Oren |
| 2017/0240350 | A1 | 8/2017 | Oren et al. |
| 2017/0240361 | A1 | 8/2017 | Glynn et al. |
| 2017/0240363 | A1 | 8/2017 | Oren |
| 2017/0267151 | A1 | 9/2017 | Oren |
| 2017/0283165 | A1 | 10/2017 | Oren et al. |
| 2017/0313497 | A1 | 11/2017 | Schaffner et al. |
| 2017/0327326 | A1 | 11/2017 | Lucas et al. |
| 2017/0334639 | A1 | 11/2017 | Hawkins et al. |
| 2017/0349226 | A1 | 12/2017 | Oren et al. |
| 2018/0028992 | A1 | 2/2018 | Stegemoeller et al. |
| 2018/0257814 | A1 | 9/2018 | Allegretti et al. |
| 2018/0369762 | A1 | 12/2018 | Hunter et al. |
| 2019/0009231 | A1 | 1/2019 | Warren et al. |
| 2019/0111401 | A1 | 4/2019 | Lucas et al. |
| 2020/0062448 | A1 | 2/2020 | Allegretti et al. |
| 2020/0062488 | A1 | 2/2020 | Jacob |
| 2020/0147566 | A1 | 5/2020 | Stegemoeller et al. |

FOREIGN PATENT DOCUMENTS

| | | | |
|---|---|---|---|
| GB | 2204847 | A1 | 11/1988 |
| JP | 2008239019 | A | 10/2008 |
| WO | 2008012513 | A2 | 1/2008 |
| WO | 2013095871 | A1 | 6/2013 |
| WO | 2013142421 | A1 | 9/2013 |
| WO | 2014018129 | A1 | 1/2014 |
| WO | 2014018236 | A2 | 5/2014 |
| WO | 2015119799 | A1 | 8/2015 |
| WO | 2015191150 | A1 | 12/2015 |
| WO | 2015192061 | A1 | 12/2015 |
| WO | 2016044012 | A1 | 3/2016 |

(56) References Cited

FOREIGN PATENT DOCUMENTS

| | | | |
|---|---|---|---|
| WO | 2016160067 | A1 | 10/2016 |
| WO | 2017/027034 | A1 | 2/2017 |

* cited by examiner

LOADING AND UNLOADING OF BULK MATERIAL CONTAINERS FOR ON SITE BLENDING

CROSS-REFERENCE TO RELATED APPLICATION

The present application is a U.S. National Stage Application of International Application No. PCT/US2016/025286 filed Mar. 31, 2016, which is incorporated herein by reference in its entirety for all purposes.

TECHNICAL FIELD

The present disclosure relates generally to transferring containerized dry bulk materials, and more particularly, to loading and unloading bulk material containers for on-site blending.

BACKGROUND

During the drilling and completion of oil and gas wells, various wellbore treating fluids are used for a number of purposes. For example, high viscosity gels are used to create fractures in oil and gas bearing formations to increase production. High viscosity and high density gels are also used to maintain positive hydrostatic pressure in the well while limiting flow of well fluids into earth formations during installation of completion equipment. High viscosity fluids are used to flow sand into wells during gravel packing operations. The high viscosity fluids are normally produced by mixing dry powder and/or granular materials and agents with water at the well site as they are needed for the particular treatment. Systems for metering and mixing the various materials are normally portable, e.g., skid- or truck-mounted, since they are needed for only short periods of time at a well site.

The bulk dry material (e.g., sand, proppant, dry chemical additives, gel particulate, or dry-gel particulate) can be transported to a well site in portable containers. The containers can be brought in on trucks, unloaded, stored on location, and manipulated about the well site when the material is needed. For instance, the portable containers can be positioned to deliver the bulk material onto a conveyor or into a hopper, or onto or into other equipment to be mixed with other materials and fluids and pumped into the well.

The rate at which the dry material is used may depend on the rate with which the treatment fluids must be pumped downhole. In high flow rate applications, the bulk material containers empty quickly and must be frequently changed. Where the speed with which the containers can be changed is not sufficient to match demand required by a desired flow rate, the flow rate must be reduced. In certain applications, this may reduce the effectiveness of the treatment operation.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
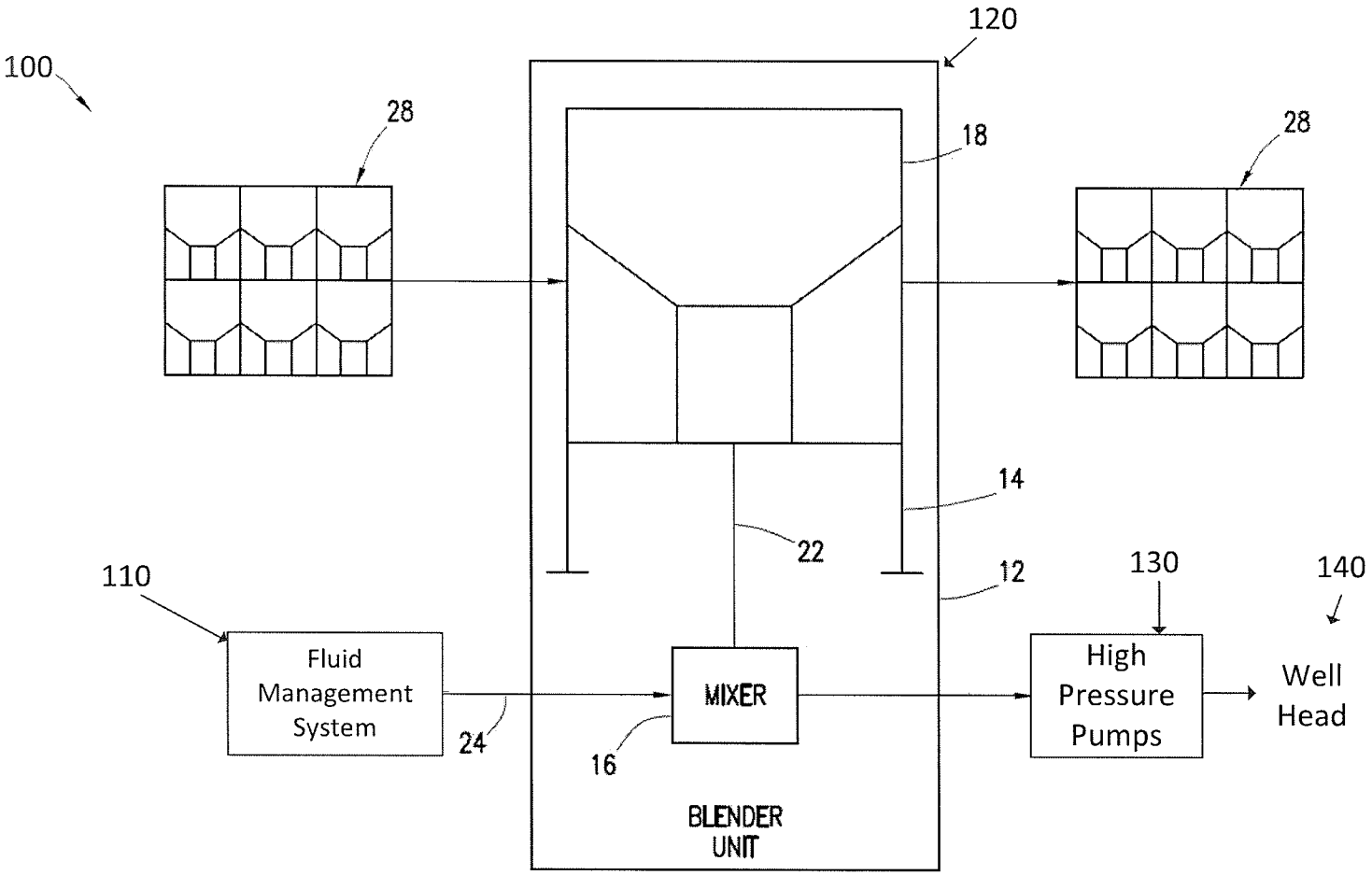
FIG. 1 is a diagram illustrating an example system for treatment operations using portable bulk material containers, according to aspects of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

To facilitate a better understanding of the present disclosure, the following examples of certain embodiments are given. In no way should the following examples be read to limit, or define, the scope of the invention. Certain embodiments according to the present disclosure may be directed to systems and methods for efficiently managing bulk material (e.g., bulk solid or liquid material). Bulk material handling systems are used in a wide variety of contexts including, but not limited to, drilling and completion of oil and gas wells, concrete mixing applications, agriculture, and others. The disclosed embodiments are directed to systems and methods for efficiently moving bulk material into a mixer of a blender unit at a job site. The disclosed techniques may be used to efficiently handle any desirable bulk material having a solid or liquid constituency including, but not limited to, sand, proppant, gel particulate, dry-gel particulate, diverting agent, dry chemical additives, liquid additives and others, or a mixture thereof.

The terms "couple" or "couples" as used herein are intended to mean either an indirect or a direct connection. Thus, if a first device couples to a second device, that connection may be through a direct connection, or through an indirect mechanical or electrical connection via other devices and connections. The term "fluidically coupled" or "in fluid communication" as used herein is intended to mean that there is either a direct or an indirect fluid flow path between two components.

In existing on-site bulk material handling applications associated with treatment operations, dry material (e.g., sand, proppant, gel particulate, or dry-gel particulate) may be transported to a job site in tanker trucks, where the dry material is then transferred directly from the tanker trucks to fixed on-site storage containers using conveyors or other transfer mechanisms. The transfer mechanisms can cause some of the dry materials or particulates from the dry materials to disperse into the air. In alternative bulk material handling applications, dry material may be transported to a job site in one or more portable containers that are individually movable in order to deliver the dry material to its intended location. In contrast to the tanker truck application, the use of individual containers may substantially reduce the amount of dry materials spread into the air by eliminating the need to transfer the dry materials to an on-site storage container. However, limitations with respect to how quickly the containers can be moved around on-site can reduce the flow rate of the treatment operation, which can be particularly problematic in high-flow rate applications, such as hydraulic fracturing operations.

The present disclosure, at least in part, addresses the speed with which bulk material containers can be transported to and moved around a job site associated with a treatment operation. As will be described in detail below, the systems and methods described herein may provide mechanisms through which portable bulk material containers can be moved and manipulated on site such that a maximum flow rate associated with a treatment operation can be used, without limitation with respect to the volume of bulk material available. It should be appreciated, however, that the systems and methods described herein are not limited to treatment operations or even oil field applications, and can be generally used in applications in which on-site bulk materials are needed.

FIG. 1 illustrates an example system 100 for treatment operations using portable bulk material containers 18, according to aspects of the present disclosure. The system 100 includes a fluid management system 110 in fluid communication with a bulk material handling/mixing portion 120. The bulk material handling/mixing portion 120 may in turn be in fluid communication with one or more high pressure pumps 130, which are in turn in fluid communication with a wellhead 140. The configuration of system 100 is not intended to be limiting, as equipment, devices, systems, or subsystems may be added to or removed from the system 100.

The fluid management system 110 may include any desirable type and number of fluid storage components, pumps, etc. for directing desired fluids to the bulk material handling/mixing portion 120. In some embodiments, the fluid management system 110 may include a ground water source, a pond, one or more frac tanks, a fluids management trailer, and/or components used to mix gels or acids into the fluid being provided to the bulk material handling/mixing portion 120. The bulk material handling/mixing portion 120 may receive one or more fluids from the fluid management system 110, mix the one or more fluids with bulk materials from bulk material containers 18 to produce a treatment fluid, and provide the treatment fluid to the one or more high pressure pumps 130. The high pressure pumps 130 direct the treatment fluid to the wellhead 140 at a high enough pressure for fracturing operations (or other operations where a high pressure fluid mixture is desired).

The bulk material handling/mixing portion 120 may comprise one or more blender units 12. As depicted, the blender unit 12 includes a container support frame 14 and a mixer 16. The system 100 also includes a portable bulk material container 18 elevated on the support frame 14 and holding a quantity of bulk material (e.g., solid or liquid treating material). Although the support frame 14 is shown holding only one bulk material container 18 in FIG. 1, it should be appreciated that the support frame 14 can be configured to hold a plurality of bulk material containers, containing one or more types of bulk materials. In addition to the support frame 14 used for receiving and holding the container 18, the blender unit 12 may also include an outlet 22 for metering bulk material from the container 18 to the mixer 16. The outlet 22 may but is not required to utilize a gravity feed to provide a controlled flow of bulk material into the mixer 16, where the dry material is mixed with fluid from the fluid management system 110 to produce treatment fluid that is pressurized and directed to the wellhead 140 by the high pressure pumps 130. The present disclosure is not limited to the blender unit configuration illustrated in FIG. 1.

During treatment operations, one or more bulk material containers may be selectively moved onto and removed from the support frame 14. Specifically, a bulk material container from a group of full or nearly full bulk material containers 28 may be first moved onto the support frame 14, where its contents are consumed over time by the blender unit 12 when blending treatment fluid. Once emptied, the bulk material container may be removed from the frame 14 and place with a group of empty bulk material containers 38, and replaced by a bulk material container from the group of full or nearly full bulk material containers 28. The speed with which this replacement can occur affects the flow rate of the treatment fluid produced by the blender unit 12. Specifically, a given flow rate and treatment fluid mixture is associated with a rate of consumption of the bulk material. Once a bulk material container 18 is empty, there may be a limited volume of bulk material available to consume and the flow rate must be limited to ensure that there is sufficient bulk material to maintain the correct treatment fluid mixture. When only a single device is used to unload and load the bulk material containers, the time it takes to replace a bulk material container can lead to a reduced flow rate that is insufficient for certain treatment operations.

Figure 2:
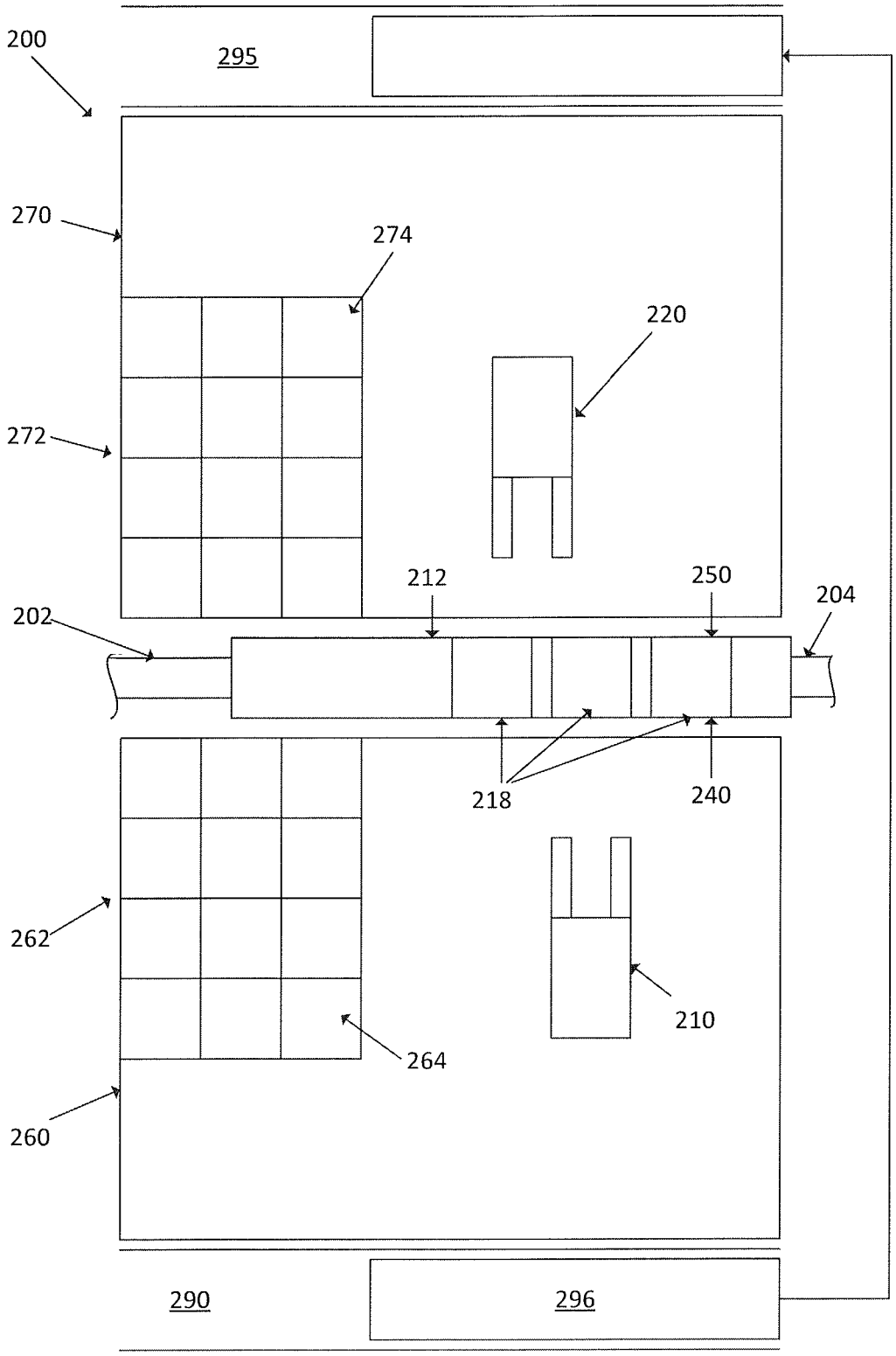
FIG. 2 is a diagram illustrating an example system for bulk material handling during a treatment operation, according to aspects of the present disclosure.

FIG. 2 is a diagram illustrating an example system 200 for bulk material handling during a treatment operation, according to aspects of the present disclosure. As depicted, the system 200 includes a blender unit 212 with similar functionality to the blender unit 12 described above. The blender unit 212 may comprise a support frame (not shown) for holding a plurality of bulk material containers 218. The support frame for holding a plurality of bulk material containers 218 may comprise a serial arrangement of multiple support frames that each support one bulk material container 218, similar to the support frame 14 in FIG. 1, or may comprise a single frame that is capable of holding a plurality of bulk material containers 218. In certain embodiments, the blender unit 212 may comprise a plurality of mixers, each associated with a different support frame, or one mixer shared by all of the bulk material containers 218. The blender unit 212 may further comprise a fluid inlet 202 and a fluid outlet 204 that respectively provide fluid communication with a fluid management system (not shown) and one or more high pressure pumps (not shown) that are similar to the systems and pumps described above.

The system 200 may further comprise a first device 210 responsible for loading bulk material containers 218 onto the blender unit 212 and a second device 220 responsible for unloading bulk material containers 218 from the blender unit 212. As depicted, the first device 210 and the second device 220 comprise forklifts, although it should be appreciated that other devices, such as cranes, may be used, and the devices 210/220 are not required to be the same type of device. Moreover, the description of the device 210 being responsible for loading bulk material containers 218 onto the blender unit 212, and the description of the device 220 being responsible for unloading bulk material containers 218 from the blender unit 212 are not intended to mean that the devices 210 and 220 cannot perform other actions.

The device 210 may be located on a first side 240 of the blender unit 212, and the device 220 may be located on a second side 250 of the blender unit 212. The first side 240 of the blender unit 212 may provide full access by the device 210 to the bulk material containers 218 positioned on the blender unit 212. Similarly, the second side 250 may provide full access by the device 220 to the bulk material containers 218 positioned on the blender unit 212. As depicted, the first side 240 and the second side 250 may correspond to opposite sides of the blender unit 212, which may prevent interference between the devices 210 and 220 and other advantages described below. However, the disclosure is not limited to the configuration of the devices 210/220, sides 240/250 and blender unit 212 depicted in FIG. 2.

The system 200 may further comprise a loading area 260 associated with the device 210 and an unloading area 270 associated with the device 220. In certain embodiments, the loading area 260 may comprise a pad, platform or other structure positioned on the first side 240 of the blender unit 212. The unloading area 270 may likewise comprise a pad, platform or other structure positioned on the second side 250 of the blender unit 212. The loading area 260 and unloading area 270, however, are not required to be structures, nor are they required to be the same type of structure to the extent they are structures. In the depicted embodiment in which the devices 210 and 220 comprise forklifts, the loading area 260 and unloading area 270 may be respectively devoted to the movement and operation of the forklifts to load bulk material containers 218 onto and unload bulk material containers 218 from the blender unit 212.

The system 200 may further comprise one or more container storage areas. In certain embodiments, the system 200 may include a first storage area 262 for full bulk material containers 264 and a second storage area 272 for empty bulk material containers 274. As depicted, the first storage area 262 is positioned within the loading area 260 on the first side 240 of the blender unit 212, and the second storage area 272 is positioned within the unloading area 270 on the second side 250 of the blender unit 212. The first storage area 262 may be accessible to the device 210 to facilitate loading one or more of the full bulk material containers 264 onto the blender unit 212. The second storage area 272 may be accessible to the device 220 to facilitate removal one or more of the empty bulk material containers 274 from the blender unit 212.

In certain embodiments, the system 200 may further comprise one or more transportation pathways in proximity to the blender unit 212 and devices 210/220. Example transportation pathways include roads, whether paved or unpaved, or other areas dedicated or otherwise intended for use by motorized vehicles, whether permanently, temporarily, or intermittently. As depicted, a first transportation pathway 290 is positioned adjacent to the loading area 260 on the first side 240 of the blender unit 212, such that it is accessible by the device 210. A second transportation pathway 295 is positioned adjacent to the unloading area 270 on the second side 250 of the blender unit 212, such that it is accessible by the device 220. Although the pathways 290 and 295 are shown as separate pathways, it should be appreciated that pathways 290 and 295 may be portions of a single pathway through or around the system 200 for use by motorized vehicles.

When the system 200 is in use, one or more trailers may deliver to a job site associated with the system 200 a load of full bulk material containers. A load of full bulk material containers may comprise, for instance, four or more full bulk material containers secured on a flatbed of a trailer. Once the one or more trailers arrives at the job site, the trailers may be positioned adjacent to the loading area 260. FIG. 2 depicts a trailer 296 positioned within the pathway 290 such that it is accessible by the device 210. At the beginning of an operation, the device 210 may remove from the trailer 296 and place on the blender unit 212, individually and in succession, a plurality of bulk material containers 218. The device 210 may remove and place enough bulk material containers 218 to fill all available slots on the blender unit 212. Once the trailer 296 has been emptied of its full bulk material containers, it may be moved to the pathway 295, such that it is adjacent to the unloading area 270 and accessible by the device 220, and another trailer (not shown), with a fresh load of full bulk material containers, may be moved into position adjacent to the loading area 260.

As the operation is undertaken, the bulk materials within the containers 218 may be consumed. When one of the containers is empty, the device 220 may remove it from the blending device 212 and either place it directly onto the trailer 296, which has been positioned adjacent to the unloading area 270, or place it in the second storage area 272. While the device 220 is removing the empty device, the device 210 may retrieve a full bulk material container directly from the trailer with the fresh load of full bulk material containers, or from the first storage area 262. When the movement of the devices 210 and 220 are coordinated, the replacement time can be reduced when compared to the use of a single device to both unload and load the bulk material containers. Moreover, positioning the devices 210 and 220 on opposite sides of the blender unit 220 allow for the devices 210 and 220 to operate without interfering with one another, and it also facilitates the use and movement of trailers to directly provide or receive bulk material containers to/from the blender unit 212.

In certain instances, the bulk materials/flow rate associated with the use of a devoted loading device 210 and a devoted unloading device 220, such as forklifts, can be three-time higher than the bulk materials/flow rate associated with the use of a single device to both load and unload the bulk material containers, even though the underlying equipment is only doubled. Time studies indicate that it takes approximately one minute for a forklift to move a bulk material container from one place to another, regardless of the type of move: loading/unloading a trailer or removing/installing a material container on the blender unit. When using a single forklift, a loading/unloading operation requires three container moves (remove empty container and place into storage; load full container; move empty trailer from storage area) which, assuming there are 450 sacks of dry material per container, provides a dry material rate of 150 sacks per minute [(450 sacks/minute)/(1 minute/move)/(3 moves)]. In contrast, when using two forklifts, as described with respect to FIG. 2, each forklift must only make a single move, which provides a dry material rate of 450 sacks per minute [(450 sacks/minute)/(1 minutes/move)/(1 moves)].

Figure 3:
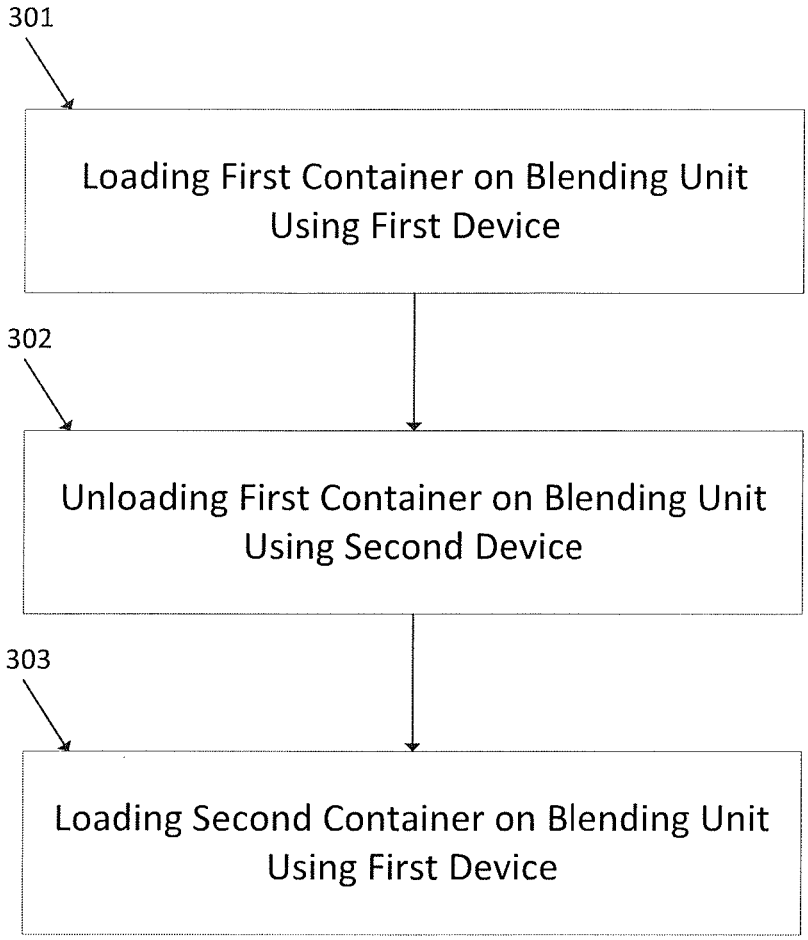
FIG. 3 is a flow diagram illustrating an example process for bulk material handling during a treatment operation, according to aspects of the present disclosure.

FIG. 3 is a flow diagram illustrating an example process 300 for bulk material handling during a treatment operation, according to aspects of the present disclosure. Step 301 may comprise loading a first bulk material container onto a blender unit using a first device. The first device may comprise a forklift positioned on a first side of the blender unit. In certain embodiments, the first bulk material container may comprise a full bulk material container that is loaded onto the blender unit directly from a trailer that transported the full bulk material container to a job site associated with a treatment operation.

Step 302 may comprise unloading the first bulk material container from the blender unit after at least some of the bulk material contained within the first bulk material container has been consumed by the blender unit. The second device may comprise a forklift positioned on a second side of the blender unit that is opposite the first side of the blender unit. In certain embodiments, the first bulk material container may be moved directly to a trailer after it is unloaded from the blender unit. The trailer may comprise the same trailer from which the first bulk material container was directly loaded onto the blender unit, or a different trailer.

Step 303 may comprise loading a second bulk material container onto the blender unit in place of the first bulk material container using a first device. In certain embodiments, the second bulk material container may comprise a full bulk material container that is loaded onto the blender unit directly from the same trailer from which the first bulk material container was loaded. In certain embodiments, the second bulk material container may comprise a full bulk material container that is loaded onto the blender unit from a different trailer than the one from which the first bulk material container was loaded.

Figure 4:
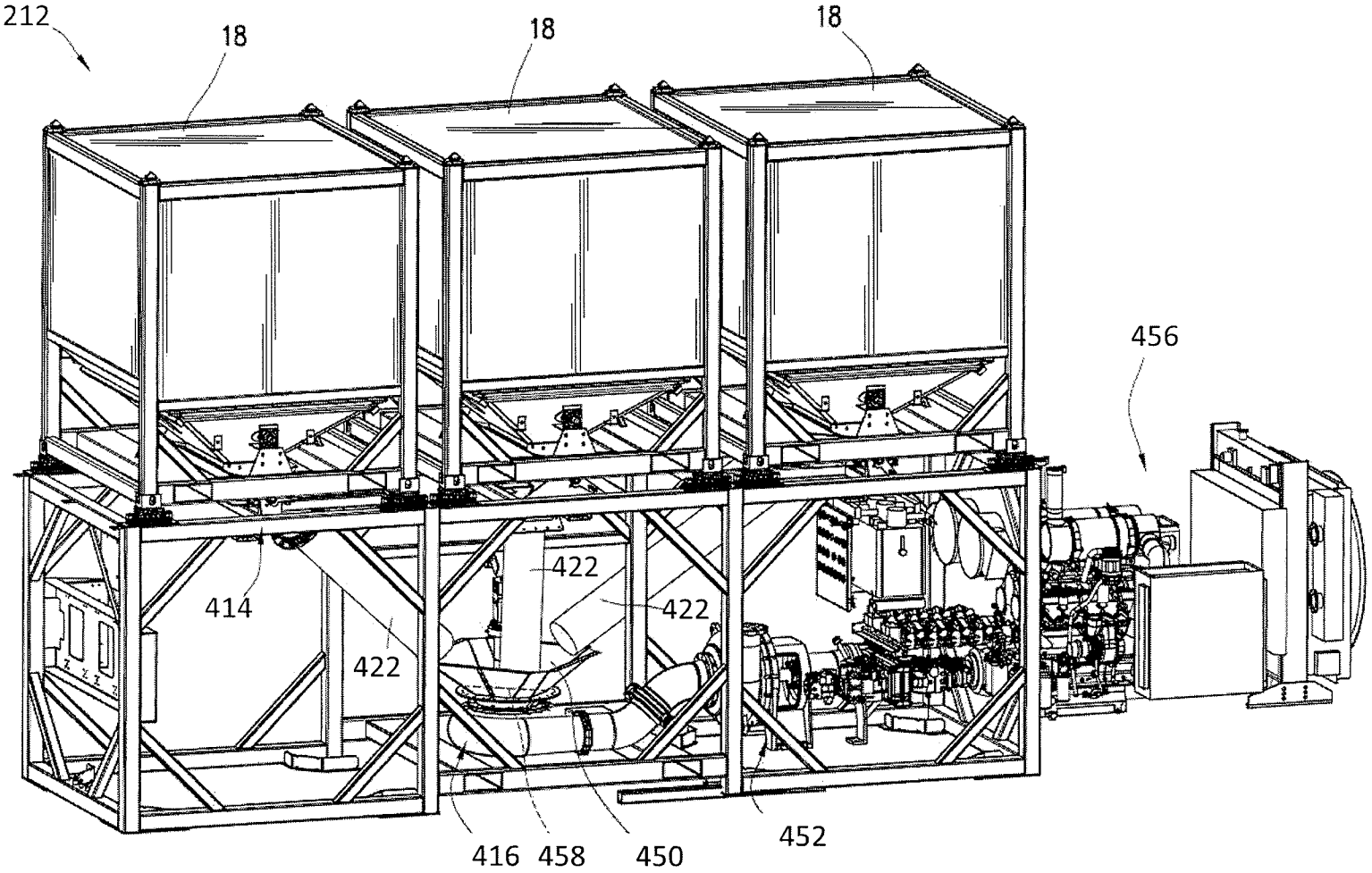
FIG. 4 is a perspective view of an example blender unit, in accordance with an embodiment of the present disclosure.

FIG. 4 illustrates an embodiment of the blender unit 212 described with respect to FIG. 2. As can be seen, the blender unit 212 includes a support frame 414. In addition to the container support frame 414, the blender unit 212 may also include one or more gravity feed outlets 422 (e.g., chutes) coupled to the support frame 414, a hopper 450, a mixer 416, one or more pumps 452 (e.g., boost pumps), a control system (not shown), a power source 456, or some combination thereof. The blender unit 212 with the support frame 14 may be formed as a mobile unit that is transportable to a desired location. This mobile blender unit 212 is constructed on a skid. In other embodiments, the mobile blender unit 212 may be constructed as a trailer to enable transportation of the blending unit 212.

In the illustrated embodiment, the container support frame 414 is designed to receive and support multiple containers 18. Specifically, the support frame 414 may be sized to receive and support up to three portable containers 18. The container support frame 414 may include several beams connected together (e.g., via welds, bolts, or rivets) to form a continuous group of cubic or rectangular shaped supports coupled end to end. For example, in the illustrated embodiment the support frame 414 generally includes one continuous elongated rectangular body with three distinct cubic/rectangular supports extending along a longitudinal axis of the blender unit 212. The container support frame 414 may include additional beams that function as trusses to help support the weight of the filled containers 18 disposed on the frame 414. Other shapes, layouts, and constructions of the container support frame 414 may be used in other embodiments. In addition, other embodiments of the blender unit 212 may include a container support frame 414 sized to receive other numbers (e.g., 1, 2, 4, 5, 6, 7, or more) portable containers 18.

As illustrated, the hopper 450 may be disposed above and mounted to the mixer 416, and the gravity feed outlets 422 may extend downward into the hopper 450. The hopper 450 may function to funnel bulk material exiting the containers 18 via the gravity feed outlets 422 to an inlet of the mixer 416. In some embodiments of the blender unit 212, a metering gate 458 may be disposed at the bottom of the hopper 450 and used to meter the flow of bulk material from the containers 18 into the mixer 416. In other embodiments, the metering gate 458 may be disposed at another position of the blender unit 212 along the bulk material flow path between the containers 18 and the mixer 416. For example, one or more metering gates 458 may be disposed along the gravity feed outlets 422.

In some embodiments, the mixer 416 may be a "tub-less" mixer. That is, the mixer 416 may be a short, relatively small-volume mixing compartment. The mixer 416 may be disposed at or near the ground level of the blender unit 212. This sizing and placement of the mixer 416 may enable the blender unit 212 to route bulk material via gravity into the mixer 416, while maintaining the support frame 414 at a height where a forklift or specialized container transport system is able to easily position the containers 18 onto and remove the containers 18 from the support frame.

An example system includes a blender unit for producing a treatment fluid, the blender unit being configured to hold at least one portable bulk material container thereon. The system further includes a first device responsible for loading portable bulk material containers onto the blender unit, and a second device responsible for unloading portable bulk material containers from the blender unit.

In one or more embodiments described in the preceding paragraph, the first device is positioned on a first side of the blender unit and the second device is positioned on a second side of the blender unit.

In one or more embodiments described in the preceding two paragraphs, the first side of the blender unit is opposite the second side of the blender unit.

In one or more embodiments described in the preceding three paragraphs, a loading area is positioned on the first side of the blender unit and an unloading area positioned on a second side of the blender unit.

In one or more embodiments described in the preceding four paragraphs, at least one of the loading area and the unloading area comprises a pad or a platform.

In one or more embodiments described in the preceding five paragraphs, the unloading area comprises a storage area for one or more portable bulk material containers that have been removed from the blender unit.

In one or more embodiments described in the preceding six paragraphs, the loading area comprises a storage area for one or more portable bulk material containers that have not been loaded onto the blender unit.

In one or more embodiments described in the preceding seven paragraphs, a transportation pathway is proximate the loading area and accessible by the first device.

In one or more embodiments described in the preceding eight paragraphs, a transportation pathway is proximate the unloading area and accessible by the second device.

In one or more embodiments described in the preceding nine paragraphs, at least one of the first and second devices comprises a forklift.

An example method may include loading a first portable bulk material container onto a blender unit using a first device, the blender unit being configured to produce a treatment fluid. The first portable bulk material container may be unloaded from the blender unit using a second device after at least some of the bulk material within the first portable bulk material container has been consumed by the blender unit. A second portable bulk material container may be loaded onto the blender unit in place of the first portable bulk material container using the first device.

In one or more embodiments described in the preceding paragraph, the first device is positioned on a first side of the blender unit and the second device is positioned on a second side of the blender unit.

In one or more embodiments described in the preceding two paragraphs, the first side of the blender unit is opposite the second side of the blender unit.

In one or more embodiments described in the preceding three paragraphs, loading the first portable bulk material container onto the blender unit using the first device comprises loading the first portable bulk material container directly onto the blender unit from a trailer that transported the first portable bulk material container to the location of the blender unit.

In one or more embodiments described in the preceding four paragraphs, unloading the first portable bulk material container from the blender unit comprises unloading the first portable bulk material container from the blender unit to a storage area on the second side of the blender unit.

In one or more embodiments described in the preceding five paragraphs, unloading the first portable bulk material container from the blender unit comprises unloading the first portable bulk material container from the blender unit directly to a trailer for transporting the first portable bulk material container away from the location of the blender unit.

In one or more embodiments described in the preceding six paragraphs, unloading the first portable bulk material container from the blender unit comprises unloading the first portable bulk material container from the blender unit directly to the trailer that transported the first portable bulk material container to the location of the blender unit.

In one or more embodiments described in the preceding seven paragraphs, the first device is positioned in a loading area on the first side of the blender unit, and the second device is positioned in an unloading area on the second side of the blender unit.

In one or more embodiments described in the preceding eight paragraphs, at least one of the loading area and the unloading area comprises a pad or a platform.

In one or more embodiments described in the preceding nine paragraphs, at least one of the first and second devices comprises a forklift.

Although the present disclosure and its advantages have been described in detail, it should be understood that various changes, substitutions and alterations can be made herein without departing from the spirit and scope of the disclosure as defined by the following claims.

What is claimed is:

1. A method, comprising:

loading a first portable bulk material container from a position outside of a blender unit onto the blender unit using a first device, wherein the blender unit is configured to produce a treatment fluid, the blender unit comprising a single trailer-mounted or skid-mounted component, wherein the single trailer-mounted or skid-mounted component has:

a solid material inlet for receiving bulk material, a fluid inlet for receiving one or more fluids, and a fluid outlet for outputting the treatment fluid as a mixture of the bulk material and the one or more fluids;

wherein the first portable bulk material container is loaded onto the single trailer-mounted or skid-mounted component of the blender unit;

unloading the first portable bulk material container from the single trailer-mounted or skid-mounted component of the blender unit to a position outside of the blender unit using a second device after at least some of the bulk material within the first portable bulk material container has been consumed by the blender unit; and loading a second portable bulk material container from a position outside of the blender unit onto the blender unit in place of the first portable bulk material container using the first device.

2. The method of claim 1, wherein the first device is positioned on a first side of the blender unit and the second device is positioned on a second side of the blender unit.

3. The method of claim 2, wherein the first side of the blender unit is opposite the second side of the blender unit.

4. The method of claim 1, wherein loading the first portable bulk material container from a position outside of the blender unit onto the blender unit using the first device comprises loading the first portable bulk material container directly onto the blender unit from a trailer that transported the first portable bulk material container to the location of the blender unit.

5. The method of claim 2, wherein unloading the first portable bulk material container from the blender unit to a position outside of the blender unit comprises unloading the first portable bulk material container from the blender unit to a storage area on the second side of the blender unit.

6. The method of claim 1, wherein unloading the first portable bulk material container from the blender unit to a position outside of the blender unit comprises unloading the first portable bulk material container from the blender unit directly to a trailer for transporting the first portable bulk material container away from the location of the blender unit.

7. The method of claim 4, wherein unloading the first portable bulk material container from the blender unit to a position outside of the blender unit comprises unloading the first portable bulk material container from the blender unit directly to the trailer that transported the first portable bulk material container to the location of the blender unit.

8. The method of claim 2, wherein the first device is positioned in a loading area on the first side of the blender unit, and the second device is positioned in an unloading area on the second side of the blender unit.

9. The method of claim 8, wherein at least one of the loading area and the unloading area comprises a pad or a platform.

10. The method of claim 1, wherein at least one of the first and second devices comprises a forklift.

11. The method of claim 1, wherein the treatment fluid is a well treatment fluid.

12. The method of claim 1, wherein the single trailer-mounted or skid-mounted component further has a mixing compartment in which the bulk material is mixed with the one or more fluids, wherein the mixing compartment has the solid material inlet, the fluid inlet, and the fluid outlet.

13. The method of claim 12, wherein the first portable bulk material container is loaded onto a support structure of the blender unit, wherein the mixing compartment is located below the support structure of the blender unit, and wherein the support structure is part of the single trailer-mounted or skid-mounted component.

14. The method of claim 13, wherein the support structure of the blender unit is accessible on a first side thereof and on a second side thereof.

15. The method of claim 14, wherein the support structure has a plurality of spaces thereon each configured to receive a bulk material container, wherein each of the plurality of spaces are accessible by the first device on the first side of the support structure and by the second device on the second side of the support structure.

16. A method, comprising:

loading a first portable bulk material container from a position outside of a blender unit onto the blender unit using a first device, the blender unit comprising a single trailer-mounted or skid-mounted component, wherein the single trailer-mounted or skid-mounted component has at least a mixer of the blender unit;

wherein the first portable bulk material container is loaded onto the single trailer-mounted or skid-mounted component of the blender unit;

producing a treatment fluid via the mixer of the blender unit by mixing bulk material released from the first portable bulk material container with at least one fluid input separately to the mixer;

unloading the first portable bulk material container from the blender unit to a position outside of the blender unit using a second device after at least some of the bulk material within the first portable bulk material container has been consumed by the blender unit; and loading a second portable bulk material container from a position outside of the blender unit onto the blender unit in place of the first portable bulk material container using the first device.

17. A method, comprising:

loading a first portable bulk material container from a position outside of a blender unit onto the blender unit using a first device, wherein the blender unit is configured to produce a treatment fluid, the blender unit comprising a single trailer-mounted or skid-mounted component, wherein the single trailer-mounted or skid-mounted component has at least a mixer configured to produce the treatment fluid, and wherein the first portable bulk material container is loaded onto the single trailer-mounted or skid-mounted component of the blender unit;

outputting the treatment fluid produced by the blender unit from the blender unit;

unloading the first portable bulk material container from the blender unit to a position outside of the blender unit using a second device after at least some of the bulk material within the first portable bulk material container has been consumed by the blender unit;

loading a second portable bulk material container from a position outside of the blender unit onto the blender unit in place of the first portable bulk material container using the first device; and maintaining the output of the treatment fluid at or above a predetermined flow rate from the blender unit throughout the unloading of the first portable bulk material container and the loading of the second portable bulk material container.

18. The method of claim 17, further comprising releasing bulk material from at least one other portable bulk material container into the mixer during the unloading of the first portable bulk material container and the loading of the second portable bulk material container to maintain the output of the treatment fluid.

19. The method of claim 1, wherein the single trailer-mounted or skid-mounted component further has:

a hopper coupled to the solid material inlet;

a support frame having a plurality of spaces thereon each configured to receive a bulk material container; and at least one gravity feed outlet having a first end located proximate one or more of the plurality of spaces of the support frame and a second end proximate the hopper, wherein the at least one gravity feed outlet routes bulk material from at least one bulk material container on the support frame directly into the hopper.

20. The method of claim 19, wherein the at least one gravity feed outlet is a plurality of gravity feed outlets each having a first end located proximate a corresponding one of the plurality of spaces of the support frame and a second end proximate the hopper, wherein the plurality of gravity feed outlets route bulk material from bulk material containers on the support frame directly into the hopper.

* * * * *